US005477565A

United States Patent [19]

Hunt, Jr.

[11] Patent Number: 5,477,565

[45] Date of Patent: Dec. 26, 1995

[54] BATTER'S HELMET WITH FACE GUARD

[75] Inventor: Wilson F. Hunt, Jr., Glenview, Ill.

[73] Assignee: Wilson Hunt International, Niles, Ill.

[21] Appl. No.: 333,266

[22] Filed: Nov. 2, 1994

[51] Int. Cl.[6] ..... A63B 71/10; A42B 3/20

[52] U.S. Cl. ..... 2/423; 2/424; 2/425

[58] Field of Search ..... 2/424, 9, 10, 425, 2/423

[56] References Cited

U.S. PATENT DOCUMENTS

| | | | |
|---|---|---|---|
| 2,105,607 | 1/1938 | McMillan . | |
| 2,780,815 | 2/1957 | Newland . | |
| 2,785,405 | 3/1957 | Snyder . | |
| 3,167,783 | 2/1965 | Wolfe . | |
| 3,886,596 | 6/1975 | Franklin et al. | 2/9 |
| 4,363,140 | 12/1982 | Correale | 2/424 X |
| 4,390,995 | 7/1983 | Walck . | |
| 4,587,677 | 5/1986 | Clement | 2/424 |
| 4,677,694 | 7/1987 | Crow . | |
| 4,885,806 | 12/1989 | Heller . | |
| 4,933,993 | 6/1990 | McClelland . | |

*Primary Examiner*—Peter Nerbun
*Attorney, Agent, or Firm*—Hill, Steadman & Simpson

[57] ABSTRACT

A baseball batter's helmet has a face guard mounted thereonto by ferrules extending through ear holes in the ear flaps of the helmet body. The face guard portion has an upper bar that engages the bill to hold the face guard in place on the helmet.

11 Claims, 2 Drawing Sheets

FIG. 1
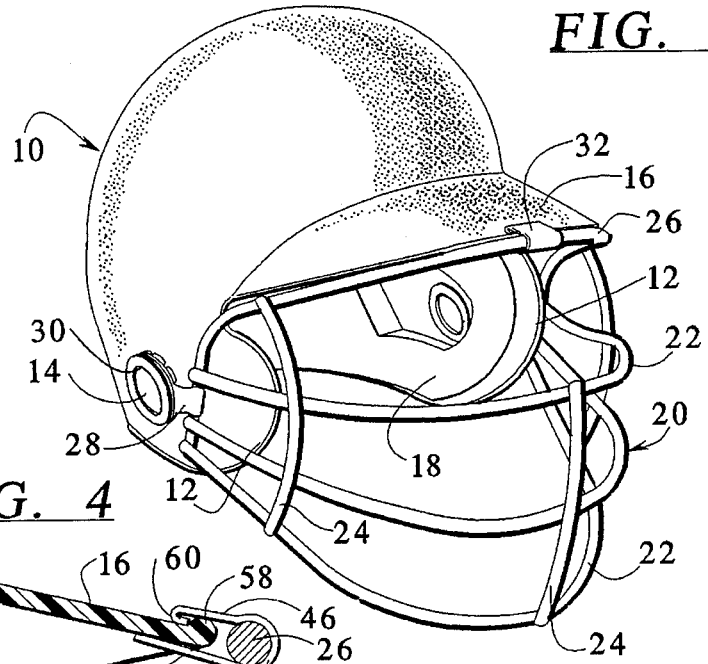
FIG. 3
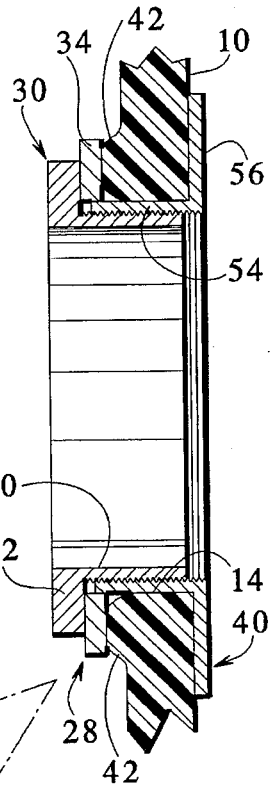
FIG. 4
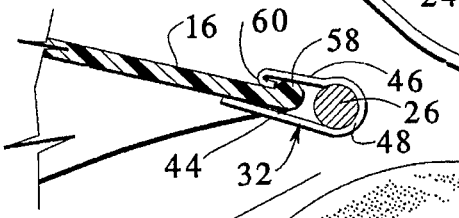
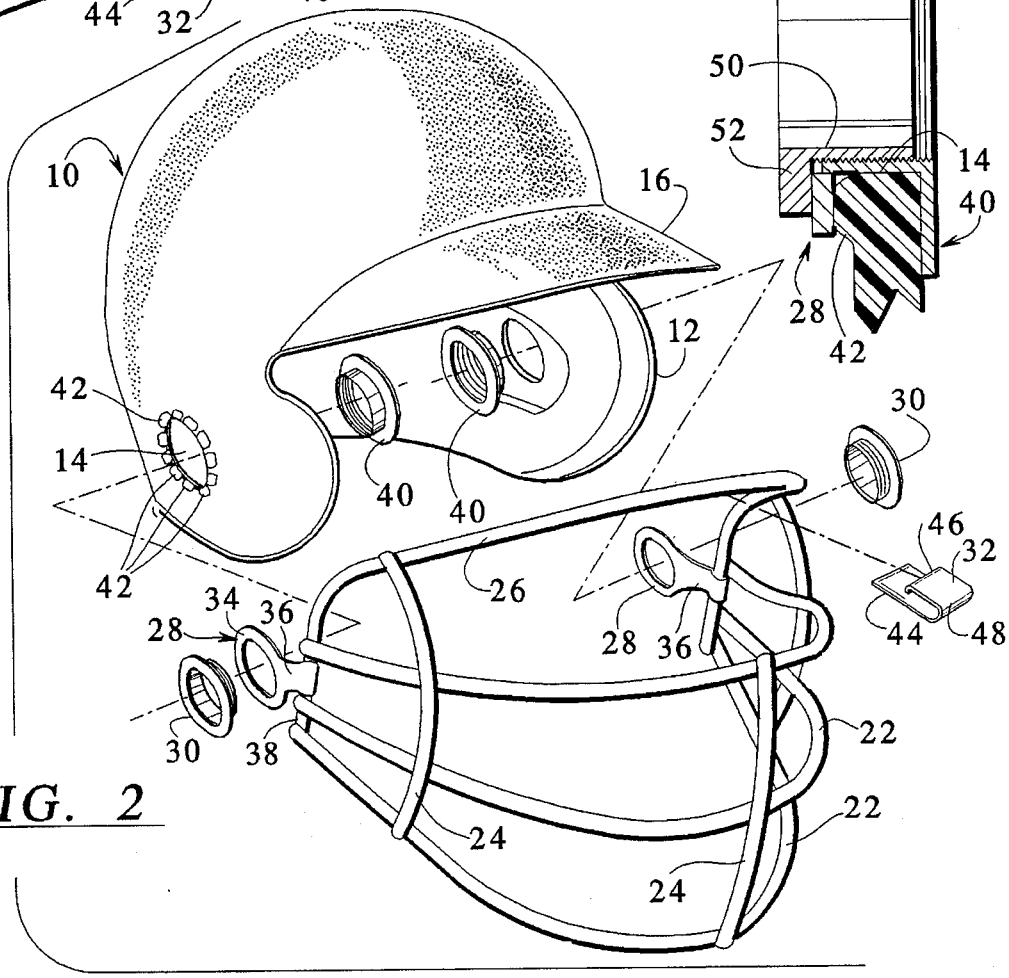
FIG. 2

BATTER' S HELMET WITH FACE GUARD

BACKGROUND OF THE INVENTION

1. Field of the Invention

The present invention related generally to a helmet and face guard, and more particularly to a baseball batter's helmet with a face guard affixed thereto.

2. Description of the Related Art

In the sport of baseball, the batter stands at home plate and the pitcher throws the ball while the batter attempts to hit the ball with a bat. Batters are occasionally struck with the thrown ball and so various protective devices for the batters are becoming common. The most common protective device is a batter's helmet, which is of hard plastic, has a bill that resembles a baseball cap and that shields the batter's eyes, and generally has at least one ear flap to protect the batter's ear from being struck by the ball.

Many children enjoy playing baseball and several different leagues of children's baseball teams have been established. As in other children's sports, there is a particular concern for the safety of the children, and so it is desirable to provide protective measures to prevent injury to the children while playing and particularly to provide a protective helmet.

SUMMARY OF THE INVENTION

An object of the present invention is to provide a face guard for a baseball batter's helmet.

Another object of the invention is to preserve the integrity of a batter's helmet when mounting a face guard thereon and thereby prevent cracking or damage to the batter's helmet.

A further advantage of the invention is to permit a face guard to be retrofit onto an existing batter's helmet.

These and other objects and advantages of the invention are provided by a face guard for a batter's helmet that is mounted to the helmet at the ear holes of the ear protecting flaps and at the bill. The face guard engages the helmet at the bill to hold the face guard in position. Mounting of the face guard onto an existing batter's helmet is accomplished without drilling holes in or otherwise modifying the helmet. The face guard includes a bar that engages the bill to hold the face guard in position on the helmet. The bill engaging bar preferably extends along the junction of the helmet body and the bill and so prevents movement of the face guard relative to the helmet.

Alternately, a clip that fastens on the bill of the helmet is provided to hold the face guard in position relative to the helmet. An upper bar is shaped to extend along the perimeter of the bill and the clip attaches to the upper bar and fastens onto the bill.

The face guard of the present invention includes a number of face bars extending across the front of the helmet and projecting forwardly therefrom to protect the wearer's face from being struck. Each of the face bars is shaped generally as a semi-oval or hyperbola having the ends extending from the two ear flaps of the helmet. Preferably, the ends of the face bars are affixed to mounting elements that fasten to the openings in the ear flaps. Cross bars extend generally transversely to and are connected to the face bars for maintaining the position of the face bars relative to one another. Mounting means for mounting the face guard on the helmet includes a pair of threaded ferrules and ferrule nuts extending through respective ear openings in the ear flaps of the helmet and through the mounting elements at the ends of the face bars.

BRIEF DESCRIPTION OF THE DRAWINGS

FIG. 1 is a perspective view of a batter's helmet and face guard according to the principles of the present invention;

FIG. 2 is an exploded view of the batter's helmet and face guard of FIG. 1;

FIG. 3 is an enlarged cross section of the connection of the face guard to the ear opening of the helmet;

FIG. 4 is an enlarged cross section of the connection of the face guard to the bill of the helmet.

DETAILED DESCRIPTION OF THE PREFERRED EMBODIMENTS

Figure 5:
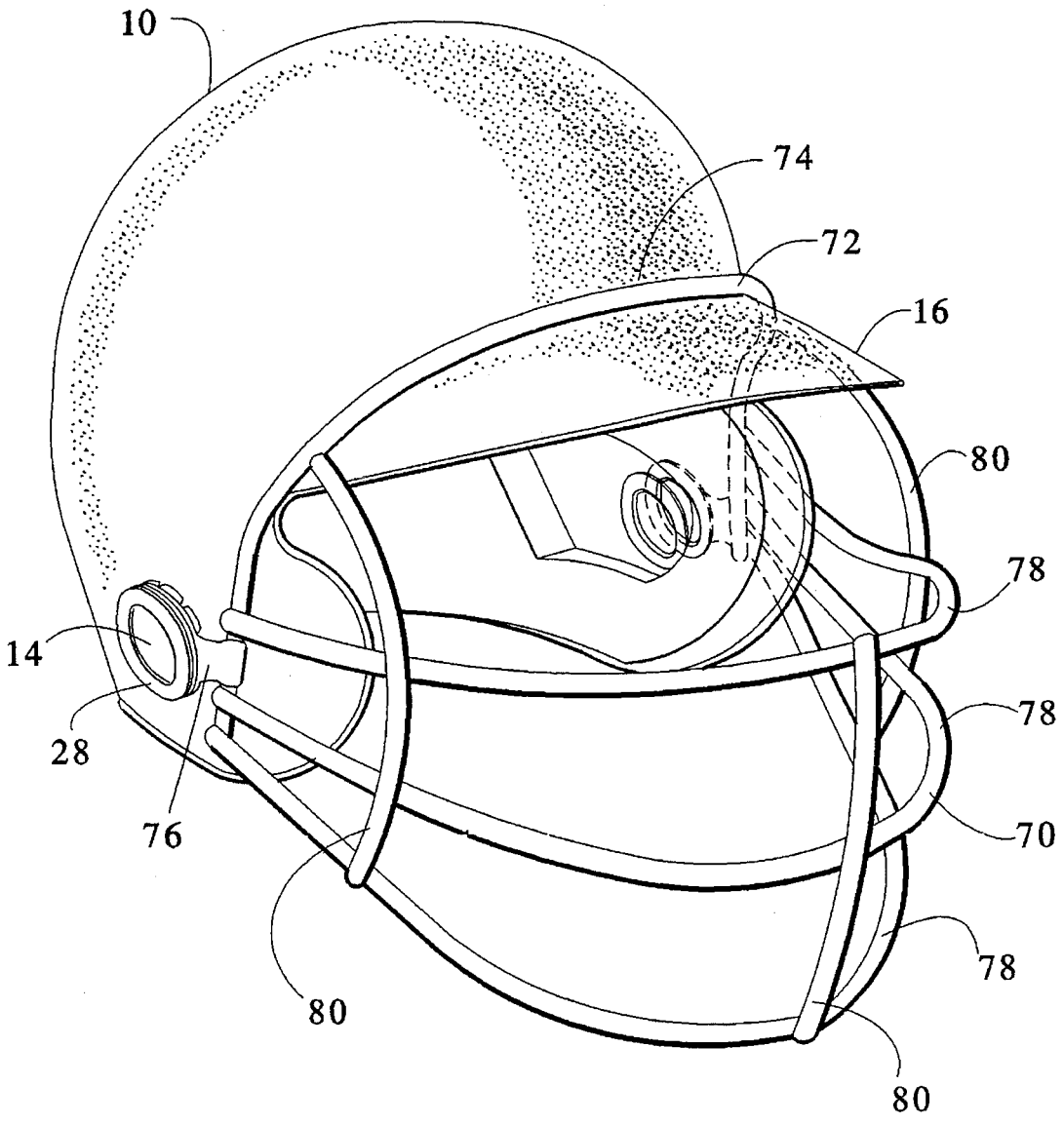
FIG. 5 is a perspective view of a preferred embodiment of the face guard on a helmet.

Referring first to FIG. 1, a baseball batter's helmet is shown which includes a helmet body 10 for covering the head of a baseball player primarily while batting so as to protect the player's head from thrown baseballs. The helmet body 10 has ear covering flaps or extensions 12 that extend downwardly from the helmet body 10 to protect the player's ears from being struck by the ball. Although some batter's helmets are known which cover only one ear (the ear toward the pitcher), the helmet 10 of the present invention has ear covering extensions 12 on both sides. Each ear covering extension 12 has an opening 14 so that the player may hear while wearing the helmet 10. The helmet body 10 also has a bill 16 extending from the front thereof to shade the eyes of the player. The helmet body 10, ear covering extensions 12 and the bill 16 are preferably molded in a single piece of a durable plastic material. Padding 18, for example, of an resilient elastomeric material is fastened within the helmet to cushion the player's head should the helmet 10 be struck by the ball.

The present batter's helmet 10 has a face guard 20 extending about the face of the wearer to prevent the player's face from being struck by the ball. The face guard 20 includes a cage-like arrangement of, for example, three face bars 22 of a semi-oval shape attached to one another by cross bars 24 to form a rigid structure. A top bar 26 extends along the periphery of the bill 16 and then downwardly on each end thereof where it is attached to the three face bars 22. In the illustrated embodiment, two of the cross bars 24 extend across the three face bars 22 and to the top bar 26. These cross bars 24 are on the either side of the face guard 20. The centrally located cross bar 24, on the other hand, extends only across the face bars 22, thereby leaving free a viewing space through which the wearer may look forward.

Two mounting members 28 is attached to the top bar 26 at the portion thereof at which the ends of the face bars 22 are connected. The mounting members 28 extend rearwardly and are attached to the helmet body 10 at the ear openings 14 by threaded ferrules 30.

A bill clip 32 is disposed at the center of the top bar 26 and connects the top bar 26 to the bill 16.

In FIG. 2, the face guard 20 may be seen removed from the helmet body 10. The mounting members 28 are rigidly affixed thereto. Each mounting member 28 is a circular portion 34 with a central hole and an elongated portion 36 extending therefrom, the elongated portion 36 being attached to the face guard, for example, at the downwardly extending ends 38 of the top bar 26.

The threaded ferrules 30 include a ferrule nut 40 that threadably attaches to the ferrule 30 through the ear opening 14 and the central hole in the circular portion 34 of the mounting member 28. The ear opening 14 of a preferred embodiment of the helmet body 10 includes reinforcement means about the ear opening. In the present example, the reinforcement means includes a series of bumps or raise portions 42 about the ear opening 14. The series of bumps 42 are arranged in an interrupted circle at the ear opening 14 and provide reinforcement about the opening 14 while enabling the mounting members 28 to press thereagainst. The series of raised bumps 42 in combination with the mounting member 28 and the ferrule enable the face guard 20 to be mounted on the helmet 10 without damage, such as cracking, to the helmet.

The clip 32 includes arms 44 and 46 extending to the bill 16 and a base portion 48 extending about the top bar 26. By clipping the top bar 26 to the bill 16, the face guard 20 is held in position and prevented from rotating about the ferrules 30.

Referring now to FIG. 3, the ferrule 30 includes an externally threaded cylinder portion 50 and a flange 52, the externally threaded cylinder portion 50 extending through the circular portion 34 of the corresponding mounting member and through the ear opening 14 from outside the helmet body. The ferrule nut 40 extends through the ear opening 14 from the inside of the helmet body 10 and includes an inside threaded cylinder portion 54 and a flange 56. When the ferrule 30 and the ferrule nut 40 are fastened to one another as shown, the respective flanges 52 and 56 hold the mounting member 28 against the series of raised bumps 42 on the outside of the helmet body 10 at the ear opening 14.

FIG. 4 shows the connection between the top bar 26 and the bill 16 by the clip 32. The bill 16 has an enlarged edge 58 that is somewhat rounded on the top surface thereof. The clip 16 includes the upper arm 46 that has an inwardly extending portion 60 directed toward the lower arm 44. The inwardly extending portion 60 of the preferred embodiment is a bent portion of the sheet metal from which the clip 16 is formed. The inwardly extending portion 60 snaps over the enlarged edge 58 of the bill 16 and holds the clip 32 and the face guard 20 in place. The upper and lower arms 44 and 46 of the clip 32 are joined by the base portion 48 that extends about the upper bar 26 of the face guard 20.

The bars 22 and 26, mounting members 28 and the clip 32 of the present face guard are preferably formed of a metal such as steel which has been coated with a rubberized or plastisized coating.

In FIG. 5 is shown a preferred embodiment wherein the face guard 70 has a top bar 72 that engages the bill 16 of the helmet 10 to hold the face guard 70 in position relative to the helmet 10. In particular, the top bar 72 of face guard 70 extends across the front of the helmet 10 at a junction 74 of the helmet 10 and the bill 16. The mounting members 76 are connected to the ear openings by the threaded ferrules 28 as before. The mounting members 76 affixed at the ear holes 14 hold the top bar 72 in the crease 74 between the bill 16 and the helmet 10 and, thus, prevent the face guard 70 from rotating relative to the helmet 10.

The face guard of the preferred embodiment includes the face bars 78 and cross bars 80 as in the previous embodiment. The top bar 72 extends downward to engage the face bars 78 and the left and right cross bars 80 as above. Likewise, the mounting members 76 are attached to the top bar 72.

The combination of the attachment in the ear holes 14 and the engagement of the top bar 72 of the face guard 70 to the bill 16 and the helmet 10 ensures that the face guard 10 is fastened securely on the helmet and will not move out of place. The face guard 10 is prevented from pivoting upward by the top bar 72 striking the helmet body 10, and is prevented from pivoting downward by the top bar 72 striking the bill 16. No additional fastening means are required other than the threaded ferrules 28 through the ear holes 14. No holes are drilled in the helmet 10 so that the helmet 10 is not weakened in any way and the integrity of the helmet 10 is not compromised. The present face guard 70 may be retrofit on existing helmets or can be provided on the helmet initially.

Although other modifications and changes may be suggested by those skilled in the art, it is the intention of the inventor to embody within the patent warranted hereon all changes and modifications as reasonably and properly come within the scope of his contribution to the art.

I claim:

1. A face guard and a batter's helmet, comprising:

a batter's helmet having ear protecting flaps with ear holes, said helmet having a bill, a plurality of bars shaped in a generally semi-oval arrangement and connected to one another to form a face guard;

first and second mounting elements connected to opposite ends of said face guard, said mounting elements each having a substantially circular opening of a substantially same size as said ear holes for placement in registration with said ear holes;

first and second ferrules extending through corresponding ones of said first and second mounting elements and said ear holes to attach said face guard to said batter's helmet;

an upper rod engaging said bill when said first and second mounting elements are in registration with said ear holes so as to hold said face guard in position relative to said batter's helmet.

2. A face guard and a batter's helmet as claimed in claim 1, wherein said upper rod is positioned at a junction between said bill and said helmet body when said first and second mounting elements are in registration with said ear holes.

3. A face guard and a batter's helmet as claimed in claim 1, wherein said first and second mounting elements each comprise a flat plate having an extension connected to said plurality of bars.

4. A face guard and a batter's helmet as claimed in claim 1, wherein said upper rod extends downwardly at each end and is affixed to said plurality of bars and to said first and second mounting elements.

5. A batter's helmet and face guard, comprising:

a helmet body for covering an upper portion of a human head;

a bill extending from a front of said helmet body;

first and second ear flaps extending from said helmet body so as to cover ears of a wearer, said first and second ear flaps each defining an ear hole through said ear flaps;

thickened portions on said ear flaps about each of said ear holes;

first and second mounting members defining mounting holes of a size corresponding to said ear holes and mounted in registration with said ear holes, said first and second mounting members bearing against said thickened portions;

first and second ferrules extending through corresponding ones of said first and second mounting members and said ear holes to mount said first and second mounting members to said helmet body;

a face guard assembly affixed to said first and second mounting members, said face guard assembly comprising a lower face guard and an upper bar rigidly connected to one another, said upper bar extending substantially along a junction of said bill and said helmet body.

6. A batter's helmet and face guard as claimed in claim 5, wherein said thickened portions comprise a series of raised bumps about said ear hole.

7. A batter's helmet and face guard as claimed in claim 5, wherein said ferrule comprises a threaded ferrule and corresponding ferrule nut, said threaded ferrule including a knurled grip.

8. A face guard and a batter's helmet as claimed in claim 1, wherein said upper rod engages an outer edge of said bill, and further comprising:

means for affixing said upper rod to said bill.

9. A face guard and a batter's helmet as claimed in claim 8, wherein said means for affixing comprises a clip extending about said upper rod and engaging said bill.

10. A face guard and a batter's helmet as claimed in claim 9, wherein the bill includes a raised lip at its peripheral edge, and said clip engages said raised lip.

11. A batter's helmet and face guard, comprising:

a helmet body for covering an upper portion of a human head;

a bill extending from a front of said helmet body;

first and second ear flaps extending from said helmet body so as to cover ears of a wearer, said first and second ear flaps each defining an ear hole through said ear flaps;

thickened portions on said ear flaps about each of said ear holes;

first and second mounting members defining mounting holes of a size corresponding to said ear holes and mounted in registration with said ear holes, said first and second mounting members bearing against said thickened portions;

first and second ferrules extending through corresponding ones of said first and second mounting members and said ear holes to mount said first and second mounting members to said helmet body;

a face guard assembly affixed to said first and second mounting members, said face guard assembly comprising a lower face guard and an upper bar rigidly connected to one another, said upper bar extending substantially along a perimeter of said bill; and clip means for connecting said upper bar to said bill.

* * * * *